US006133929A

United States Patent [19]

Negoro et al.

[11] Patent Number: 6,133,929

[45] Date of Patent: Oct. 17, 2000

[54] MELTING TYPE THERMAL TRANSFER RECORDING DEVICE AND MELTING TYPE THERMAL TRANSFER RECORDING METHOD

[75] Inventors: Toshihiko Negoro; Yoshiyuki Obata; Fumiaki Shinozaki, all of Osaka, Japan

[73] Assignee: Fujicopian Co., Ltd., Osaka, Japan

[21] Appl. No.: 09/392,094

[22] Filed: Sep. 8, 1999

[51] Int. Cl.[7] ..... B41J 2/325

[52] U.S. Cl. ..... 347/171; 347/221; 347/217; 347/206

[58] Field of Search ..... 347/171, 221, 347/217, 206

[56] References Cited

U.S. PATENT DOCUMENTS 5,521,626 5/1996 Tanaka et al. ..... 347/221

FOREIGN PATENT DOCUMENTS 7-179053 7/1995 Japan ..... 347/217

*Primary Examiner*—Huan Tran
*Attorney, Agent, or Firm*—Fish & Neave

[57] ABSTRACT

A melting type thermal transfer recording system capable of providing multi-gradation images of high resolution and high image quality comparable to those of ink jet recording system or sublimation type thermal transfer recording system is disclosed which comprising: a donor film comprising a thin film and a thermal melting type ink layer provided on the thin film, the thermal melting type ink layer having a thickness in a range of 0.5 to 2.5 $\mu$m, a surface porous type recording medium comprising a base material and a porous ink receiving layer having numerous minute pores provided on the base material, the ratio of the first total area of aperture portions that are occupied by all the pores to the whole surface area of the porous ink receiving layer being in a range of 10 to 60%, and the ratio of the second total area of aperture portions that are occupied by pores having a pore diameter of 0.5 to 20 $\mu$m to the first total area of the aperture portions being 70 to 100%, a thermal head comprising a plurality of heating resistor units arranged in a line at intervals of 8 dots/mm or less, each of the heating resistor units comprising a pair of heating resistor elements of identical shape, a gradation control means for controlling an amount of an ink of the ink layer melted with the heating resistor units by controlling an amount of electricity supplied to the thermal head.

6 Claims, 16 Drawing Sheets

MELTING TYPE THERMAL TRANSFER RECORDING DEVICE AND MELTING TYPE THERMAL TRANSFER RECORDING METHOD

BACKGROUND OF THE INVENTION

The present invention relates to a melting type thermal transfer recording device and recording method wherein multi-gradation representation of high resolution and high quality is achieved by using thermal melting type ink.

The multi-gradation representation using thermal melting type ink is generally performed by a dither method employing a plurality of pixels (matrix), or by a heat concentration method employing a thermal head with special heating resistors (see, for instance, "Imaging" Part I, Photographic Industry Publishing. Co., Pages 103 to 108).

However, the method employing a plurality of pixels has a drawback that the resolution is degraded so that the image quality is remarkably worsened, and also the heat concentration method wherein a special thermal head is used as disclosed in JP-A-60-58877 has a drawback that printing costs are increased even though the thermal head is a conventional one.

For solving these problems, a melting type thermal transfer recording system which enables the achievement of a multi-gradation image of high quality employing a thermal head as used in ordinary thermal transfer recording devices was proposed in JP,A, 6-286181 and U.S. Pat. No. 5,521, 626.

This proposal is directed to a melting type thermal transfer printing system comprising: an ink ribbon comprising a thin film and a thermal melting type ink applied on the thin film at an amount of not more than 2.5 g/m$^2$, a surface porous recording medium comprising a base material and a surface porous layer formed on the base material and having a pore diameter of 1 to 10 $\mu$m, a thermal head comprising a plurality of heating resistors arranged in a line at intervals of 8 dot/mm or less, each of the resistors, when generating heat, showing such a temperature gradient that the temperature is highest at the central portion thereof and decreases toward the periphery thereof, and a gradation control circuit for controlling an area of the ink melted with the heating resistors by controlling an amount of electricity supplied to the thermal head, wherein the system is arranged such that while the ink of the ink ribbon is brought into close contact with the porous ink receiving layer of the surface porous recording medium whereupon the thermal head is pressed from the thin film side of the ink ribbon, the area of melted ink of the ink layer is controlled by the gradation control means to form a multi-gradation image on the surface porous recording medium.

This recording system is capable of forming outstandingly excellent multi-gradation images as compared with the conventional dither method.

However, it often happens in the above recording system that the amount of ink that is transferred to the surface porous recording medium is not stable due to factors such as conditions for exfoliating the ink ribbon, thereby giving uneven images. Further, the image reproducibility in low density regions is inferior as compared with the above-mentioned heat concentration method using a special thermal head. On the other hand, improvements in techniques for obtaining high quality images in recording methods such as ink jet systems and sublimation type thermal transfer systems wherein the gradation is achieved by a density gradation are quite remarkable. At the present stage the above-mentioned conventional recording system is inferior in image quality to the image forming systems using such methods.

In view of the foregoing, it is an object of the present invention to provide a recording device and recording method which employ melting type thermal transfer system providing images excellent in light resistance and water resistance at low cost, and which are capable of providing multi-gradation images of high resolution and high image quality that are identical to or superior to those obtained by ink jet recording systems or sublimation type thermal transfer recording systems.

SUMMARY OF THE INVENTION

The present invention provides (1) a melting type thermal transfer recording device comprising:

a donor film comprising a thin film and a thermal melting type ink layer provided on the thin film, the thermal melting type ink layer having a thickness in a range of 0.5 to 2.5 $\mu$m, a surface porous type recording medium comprising a base material and a porous ink receiving layer having numerous minute pores provided on the base material, the ratio of the first total area of aperture portions that are occupied by all the pores to the whole surface area of the porous ink receiving layer being in a range of 10 to 60%, and the ratio of the second total area of aperture portions that are occupied by pores having a pore diameter of 0.5 to 20 $\mu$m to the first total area of the aperture portions being 70 to 100%, a thermal head comprising a plurality of heating resistor units arranged in a line at intervals of 8 dot/mm or less, each of the heating resistor units comprising a pair of heating resistor elements of identical shape, a gradation control means for controlling an amount of an ink of the ink layer melted with the heating resistor units by controlling an amount of electricity supplied to the thermal head, wherein the device is arranged such that while the ink layer of the donor film is brought into close contact with the porous ink receiving layer of the surface porous recording medium whereupon the thermal head is pressed from the thin film side of the donor film, the amount of melted ink of the ink layer is controlled by the gradation control means to form a multi-gradation image on the surface porous recording medium.

The present invention further provides (2) a melting type thermal transfer recording device according to the above (1), wherein the thermal head is a near edge type thermal head with an edge distance of not more than 150 $\mu$m, and the pressing force of the thermal head is in a range of 0.20 to 1.25 kg/cm, and wherein there is provided a mechanism for exfoliating the donor film from the surface porous recording medium within 6 msec after the heating with the heating resistor units.

The present invention still further provides (3) a melting type thermal transfer recording device according to the above (1), wherein a distance d1 between a pair of heating resistor elements of identical shape and a distance d2 between the heating resistor units in the thermal head are related to each other in that they satisfy: $0.25 \times d2 < d1 \leqq 0.4 \times d2$ .

The present invention also provides (4) a melting type thermal transfer recording method comprising: using a donor film comprising a thin film and a thermal melting type ink layer provided on the thin film, the thermal melting type ink layer having a thickness in a range of 0.5 to 2.5 $\mu$m, a surface porous type recording medium comprising a base material and a porous ink receiving layer having numerous minute pores provided on the base material, the ratio of the first total area of aperture portions that are occupied by all the pores to the whole surface area of the porous ink receiving layer being in a range of 10 to 60%, and the ratio of the second total area of aperture portions that are occupied by pores having a pore diameter of 0.5 to 20 $\mu$m to the first total area of the aperture portions being 70 to 100%, and a thermal head comprising a plurality of heating resistor units arranged in a line at intervals of 8 dot/mm or less, each of the heating resistor units comprising a pair of heating resistor elements of identical shape; and while bringing the ink layer of the donor film into close contact with the porous ink receiving layer of the surface porous recording medium and pressing the thermal head thereupon from the thin film side of the donor film, controlling an amount of an ink of the ink layer melted with the heating resistor units by controlling an amount of electricity supplied to the thermal head to form a multi-gradation image on the surface porous recording medium.

The present invention further provides (5) a melting type thermal transfer recording method according to the above (4), wherein the thermal head is a near edge type thermal head with an edge distance of not more than 150 $\mu$m, and the pressing force of the thermal head is in a range of 0.20 to 1.25 kg/cm, and wherein the donor film is exfoliated from the surface porous recording medium within 6 msec after the heating with the heating resistor units.

The present invention still further provides (6) a melting type thermal transfer recording method according to the above (4), wherein a distance d1 between a pair of heating resistor elements of identical shape and a distance d2 between the heating resistor units in the thermal head are related to each other in that they satisfy: $0.25 \times d2 < d1 \leqq 0.4 \times d2$ .

DETAILED DESCRIPTION

As already mentioned, JP, A, 6-286181 discloses detailed explanations related to a melting type thermal transfer printing system comprising: an ink ribbon comprising a thin film and a thermal melting type ink applied on the thin film at an amount of not more than 2.5 g/m$^2$, a surface porous recording medium comprising a base material and a surface porous layer formed on the base material and having a pore diameter of 1 to 10 $\mu$m, a thermal head comprising a plurality of heating resistors arranged in a line at intervals of 8 dot/mm or less, each of the resistors, when generating heat, showing such a temperature gradient that the temperature is highest at the central portion thereof and decreases toward the periphery thereof, and a gradation control circuit for controlling an area of the ink melted with the heating resistors by controlling an amount of electricity supplied to the thermal head, wherein the system is arranged such that while the ink of the ink ribbon is brought into close contact with the porous ink receiving layer of the surface porous recording medium whereupon the thermal head is pressed from the thin film side of the ink ribbon, the area of melted ink of the ink layer is controlled by the gradation control means to form a multi-gradation image on the surface porous recording medium.

Figure 1A:
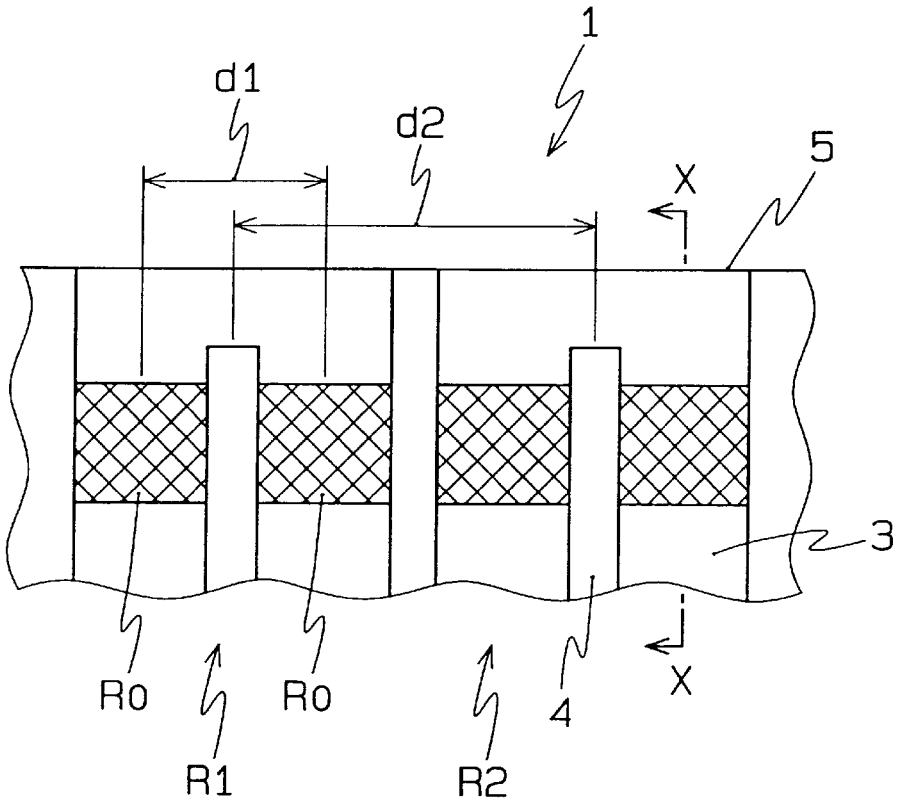
FIG. 1(A) is a partial plan view showing an example of a thermal head used in the present invention.
Figure 1B:
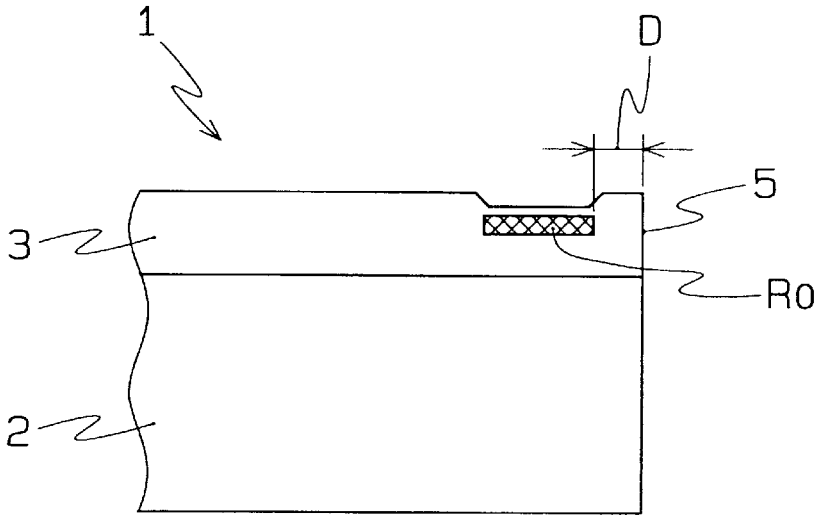
FIG. 1(B) is a sectional view thereof taken along line X—X.
Figure 2:
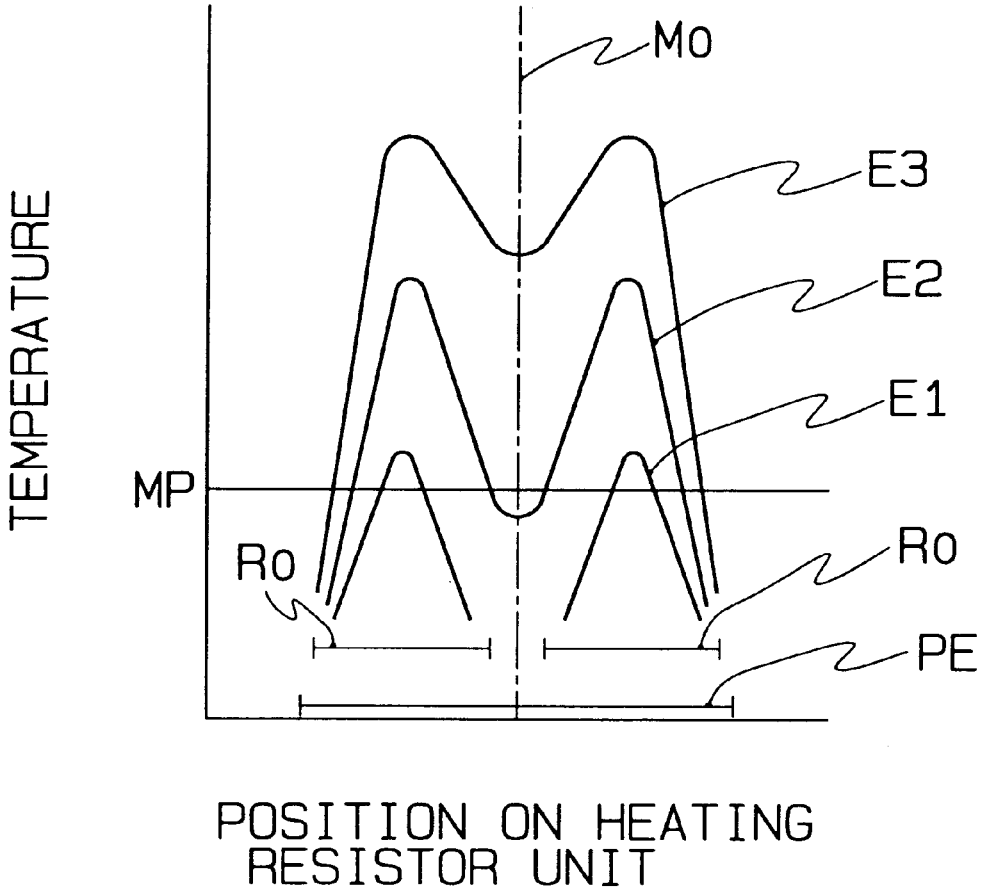
FIG. 2 is a graph showing temperature distributions on a heating resistor unit of the thermal head according to the present invention.

The most differentiating technical point between the present invention and the prior art, wherein the former aims to obtain multi-gradation images of further improved quality by improving the latter prior art and the latter is characterized in that no special thermal head is utilized, is that the present invention utilizes a thermal head as shown in FIG. 1 wherein a plurality of heating resistor units each comprised of a pair of heating resistor elements of identical shape are arranged in a line at intervals of not more than 8 dot/mm, and preferably a real edge type thermal head. The heating resistor units, at the time when generating heat, has a temperature distribution as shown in FIG. 2 wherein the temperature does not become maximum at a central portion Mo (intermediate portion between a pair of heating resistor elements) but maximum portions exist on both sides of the central portion Mo and the temperature decreases toward the peripheral portions thereof.

The second point of difference exists in that in the present invention, recording is performed by utilizing the thermal head characteristic of the present invention while employing a donor film characterized in that a thermal melting type ink layer with a thickness in a range of 0.5 to 2.5 μm is provided on a thin film and an optimized range for a surface porous type recording medium characterized in that a porous ink receiving layer having numerous minute pores is provided on a base material, in that the ratio of the first total area of opening portions that are occupied by all the pores to the whole surface area of the porous ink receiving layer is in a range of 10 to 60%, and the ratio of the second total area of opening portions that are occupied by pores having a pore diameter of 0.5 to 20 μm to the first total area of the opening portions is 70 to 100%.

Due to these points of difference, the present invention has enables one to obtain a multi-gradation image of outstandingly high image quality as compared with the system disclosed in JP, A, 6-286181 mentioned above.

Upon performing studies on thermal heads, donor films, recording media or heating controlling methods or the like from various angles, the present invention provides a melting type thermal transfer recording device and recording method which are capable of obtaining multi-gradation images of outstandingly high resolution and high image quality employing a thermal head as utilized in ordinary thermal transfer recording devices.

Figure 3:
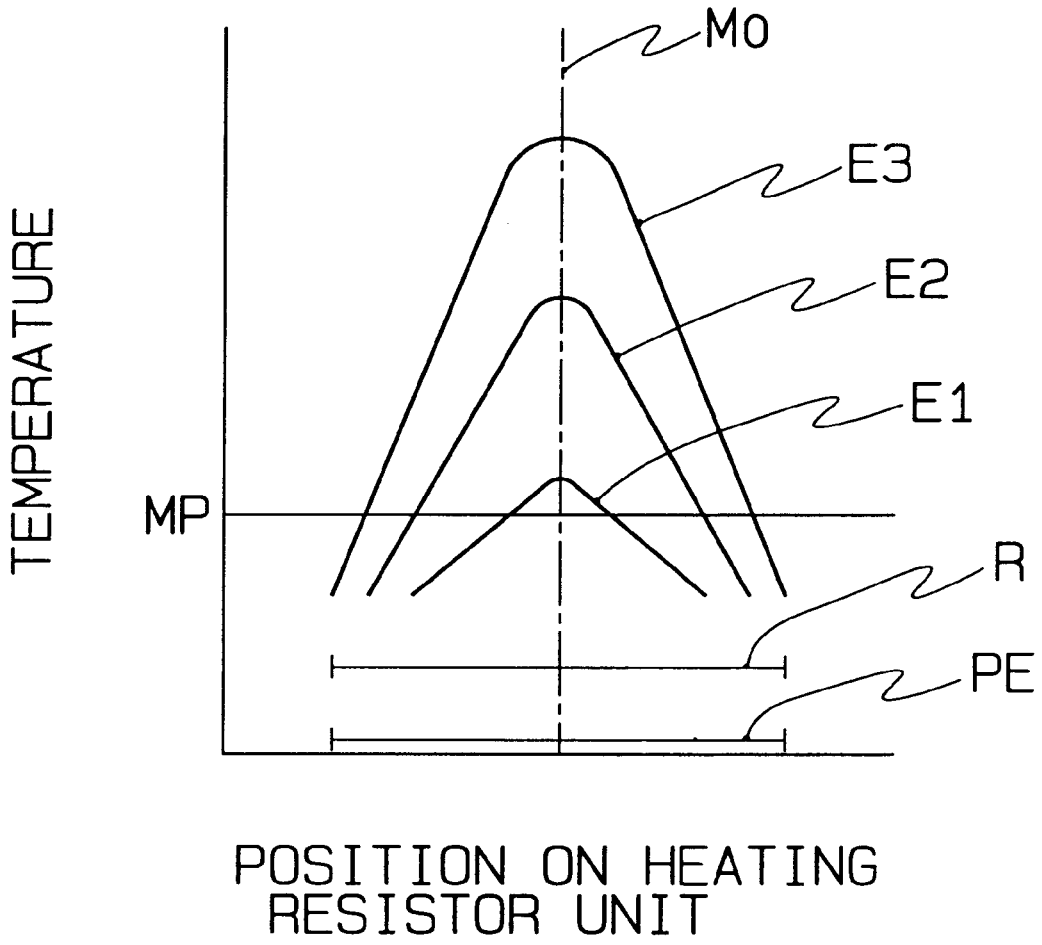
FIG. 3 is a graph showing temperature distributions on a heating resistor unit of prior art.
Figure 4:
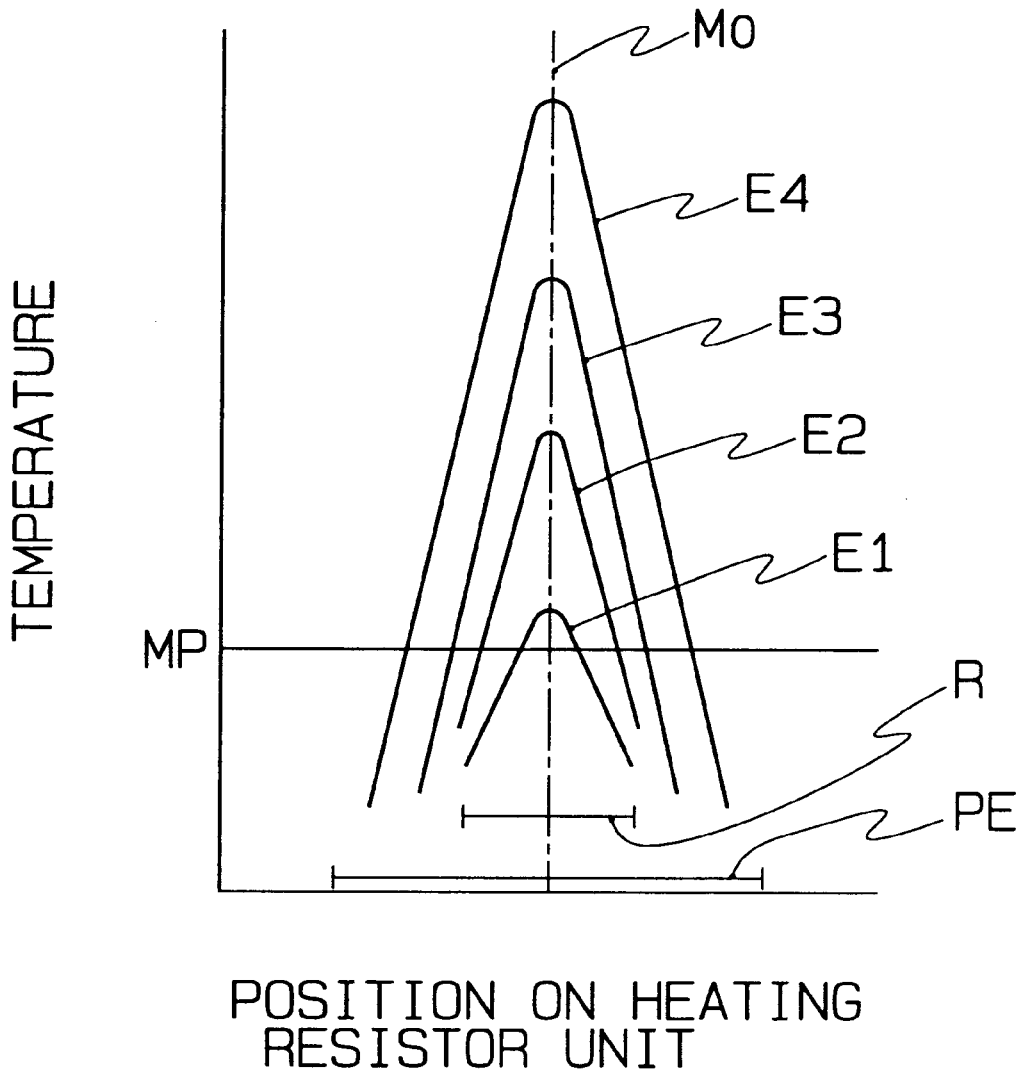
FIG. 4 is a graph showing temperature distributions on a heating resistor unit of other prior art.

The principle of multi-gradation representation employing thermal melting type ink according to the present invention and that according to the prior art will now be explained with reference to FIGS. 2 to 4. FIG. 3 is a graph showing temperature distributions of a common heating resistor unit R consisting of a single heating resistor element when the heating resistor unit R is activated, indicating three cases in which an applied energy is large (curve E3), mediate (curve E2), and small (curve E1). Mo indicates a central line of the heating resistor unit R. PE indicates a size of a single pixel or dot. The heating resistor unit R shows a temperature gradient in which the temperature is high at the central portion and decreases toward the peripheral portions thereof, whereby portions of the heating resistor unit with a temperature of not less than a melting temperature, MP, of an ink are allowed to melt the ink. Utilizing this temperature gradient, the amount of ink melted can be controlled. That is, current to be applied to the heating resistor unit is varied depending on a gradation to be represented, whereby an area of ink to be transferred onto the recording medium can be controlled to perform multi-gradation representation.

In the above method for multi-gradation representation, it is advantageous in terms of image reproducibility in low density regions that the size of the heating resistor unit be small. FIG. 4 is a graph showing temperature distributions with a heating resistor unit of a small size. It can be understood that a narrow temperature distribution is favorable for the reproduction of small areas. However, when the heating resistor unit is of a small size, the temperature of the central portion needs to be made very high (curve E4) for printing in high density regions so that the temperature of the donor film becomes excessively high, resulting in failure through running of the donor film owing to the melting of the base material. On the other hand, lowering of the temperature results in the drawback wherein printing of solid portions cannot be performed.

For solving such problems, a method in which the size of the heating resistor unit is made small while the number of the heating resistor units is increased may be considered. In such a method, the amount of data for printing a single line is increased so that not only the thermal head but also the whole device becomes expensive.

In contrast to that, it has been enabled in the present invention to achieve temperature distributions as shown in FIG. 2 by composing the heating resistor unit R of a pair of heating resistor elements of identical shape. Since the heating resistor elements Ro are of small size, the temperature distribution in low temperature regions where the printing energy is small becomes sharp, whereby reproduction in low density region is made easy. On the other hand, the temperature distribution in high temperature regions where the printing energy is large is sharp at peripheral portions and the temperature at the central portion of the heating resistor unit is increased since the temperature distributions of two heating resistor elements are substantially summed. Accordingly, printing in high density regions is enabled at a temperature of the same level as achieved by the conventional heating resistor unit. No problems are caused even in solid printing. Further, by composing a heating resistor unit of a pair of heating resistor elements of identical shape, it is no longer required to increase the number of heating resistor units so that the amount of data for printing a single line remains similar to that of conventional methods and needs not be increased.

Thus, it has been enabled in the present invention to provide a printing method capable of achieving favorable reproduction in low density regions and also performing printing in high density regions with no problems by employing a thermal head in which a heating resistor unit is composed of a pair of heating resistor elements of identical shape.

The thermal head as employed in the present invention will now be explained. FIG. 1(A) is a partial plan view showing an example of the thermal head as employed in the present invention, and FIG. 1(B) is a sectional view thereof taken along line X—X. Reference numeral 1 denotes a thermal head, wherein the thermal head 1 is arranged such that a ceramics layer (glaze) 3 is formed on a radiating body 2 made of aluminum or the like and heating resistor elements Ro are formed in a part thereof. A heating resistor unit Ri (i=1 to n) is composed of a pair of heating resistor elements Ro of identical shape, and a plurality of heating resistor units $R_1$ to $R_n$ are aligned in a line. It should be noted that the term "heating resistor unit R" may be used in case that it is not necessary to indicate individual ones of plural heating resistor units. A pair of heating resistor elements Ro are of identical shape and have identical heat generating characteristics, and are driven at identical conditions. A pair of heating resistor elements Ro are thermally separated from each other by a clearance 4.

Figure 5A:
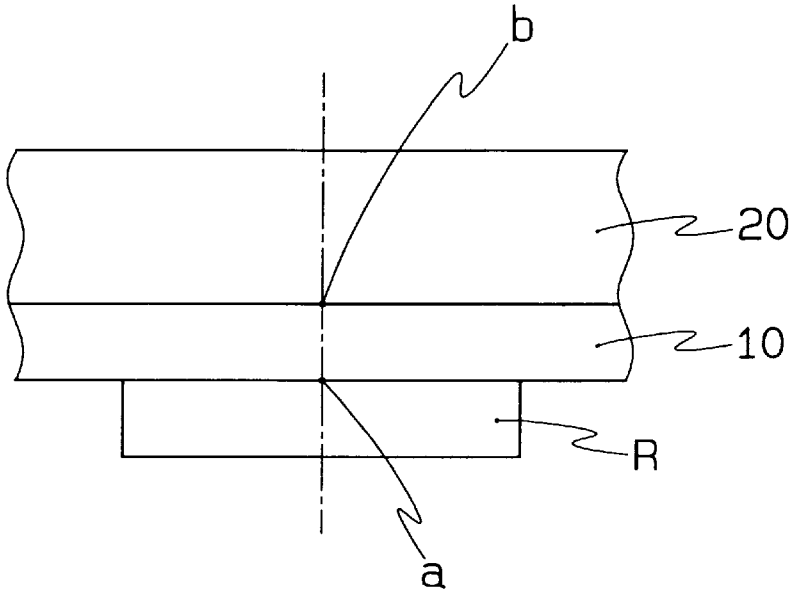
FIG. 5(A) is a partial sectional view showing a state where a donor film is brought into close contact with a surface porous type recording medium with a thermal head according to the present invention.
Figure 5B:
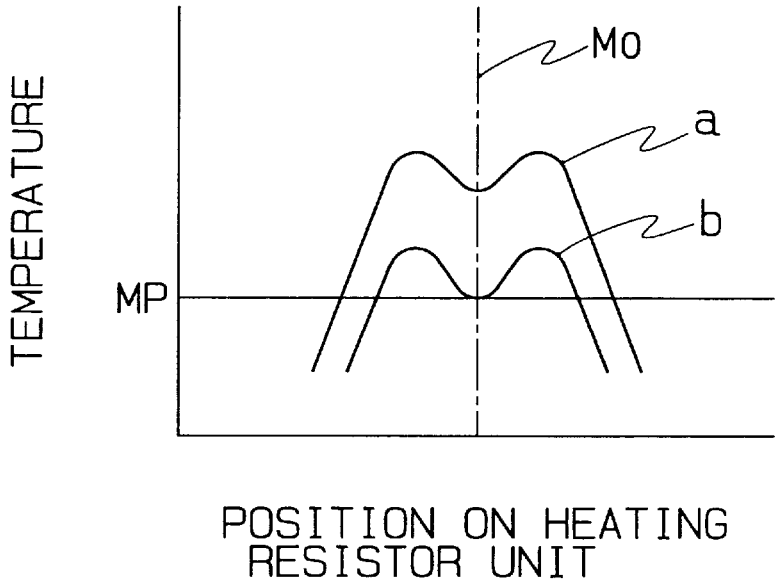
FIG. 5(B) is a graph showing temperature distributions at points a and b when the donor film is heated with the thermal head in the state shown in FIG. 5(A).

As known, transfer is performed in a thermal transfer recording device by bringing heating resistor units R of the thermal head 1 into close contact with a donor film 10 which in turn is brought into close contact with a recording medium 20, and allowing the heating resistor units R to generate heat while being pressed against the donor film 10 to transfer ink of the donor film 10 onto the recording medium 20, as shown in FIG. 5(A). FIG. 5(B) is a graph showing temperature distributions at point a (the surface of the heating resistor unit R) and point b (the surface of the recording medium 20) of FIG. 5(A). The temperature of point b on the surface of the recording medium 20 is varied depending on the thickness of the donor film 10 and the temperature gradient becomes steeper by approaching the temperature distribution of the heating resistor unit R as the thickness of the donor film becomes smaller, so that controlling the area of ink melted becomes easier. In this respect, the thickness of the donor film 10 is preferably small, and a thin film having a thickness of 2.5 to 4.5 μm is generally used as a favorable base material for the donor film 10. The thickness of the donor film 10 is determined by the thickness of the thin film and that of ink applied on the film. Therefore, it is possible to allow the surface temperature distribution of the recording medium 20 to approach the temperature distribution of the heating resistor unit R by decreasing the amount of ink applied as much as possible.

Figure 6A:
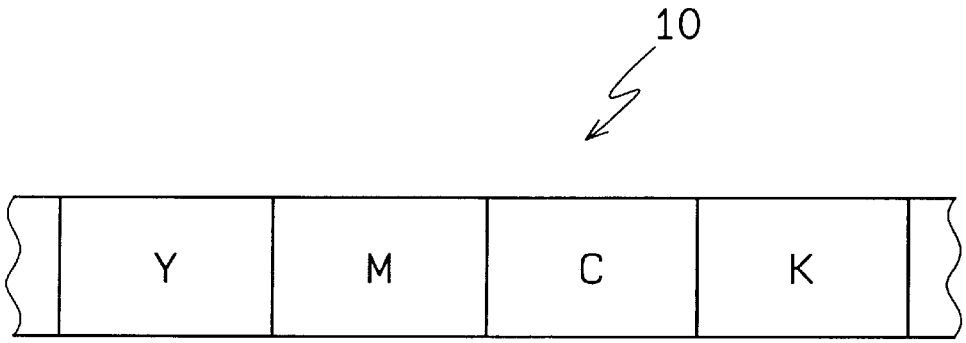
FIG. 6(A) is a partial plan view showing an example of an ink donor film used in the present invention.
Figure 6B:
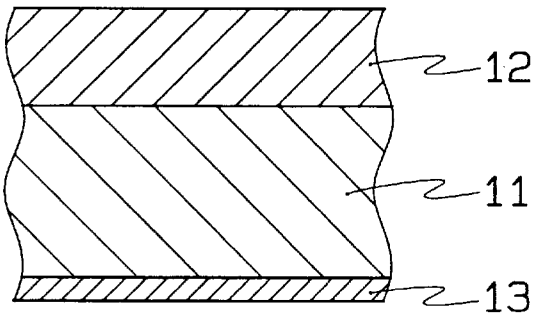
FIG. 6(B) is a sectional view thereof.
Figure 7:
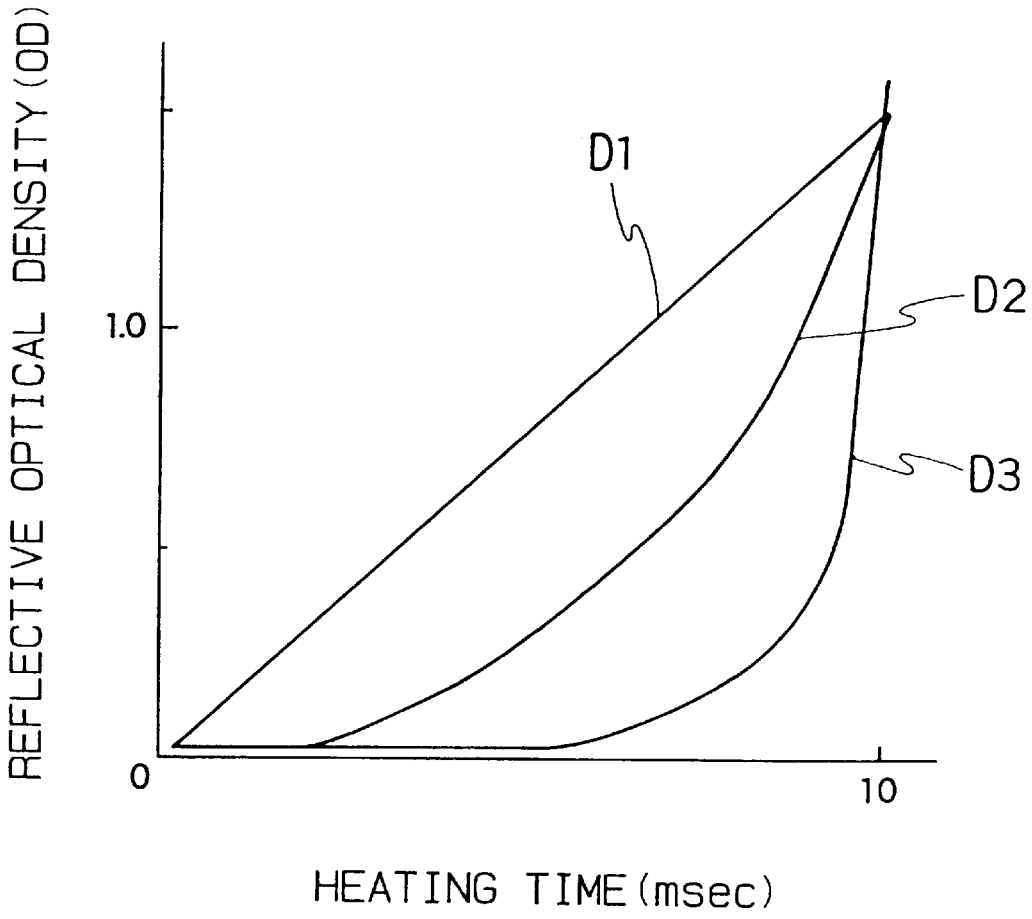
FIG. 7 is a paragraph showing a relationship between the heating time of the donor film and the reflective optical density of the ink transferred when the thickness of the ink applied is changed.

FIG. 6(A) is a partial plan view showing an example of the donor film used in the melting type thermal transfer recording device and recording method of the present invention, and FIG. 6(B) is a sectional view thereof. As shown in FIGS. 6(A), (B), the donor film 10 is arranged such that plural thermal melting type inks comprising a set of a plurality of colors (e.g. yellow (Y), magenta (M), cyan (C), and further, if necessary, black (K)) are sequentially applied onto a thin film 11 in the longitudinal direction thereof to form ink layers 12 of respective colors. If necessary, a back coat 13 may be formed on the rear side of the thin film 11. It is also possible to respectively apply inks of the plurality of colors onto individual thin films 11. FIG. 7 is a graph showing a relationship between the time heating and the reflective optical density (OD) of ink transferred onto recording medium 20, wherein thermal transfer recording is performed by using a donor film 10 obtained by forming an ink layer 12 by applying ink onto a film 11 having a thickness of 4.5 μm and which is provided with a back coat 13 having a thickness of 0.05 μm, and wherein the thickness of applied ink is 2.0 μm (curve D1), 2.5 μm (curve D2), and 3.0 μm (curve D3), respectively. A conventional donor film is, for instance, one wherein an ink is applied in a thickness of not less than 3.0 μm on a film having a thickness of 4.5 μm. it is apparent from FIG. 7 that favorable multi-gradation representation can be achieved by setting the thickness of ink to be applied on the film to not more than 2.5 μm. It should be noted that in case the thickness of applied ink is too small, ink is completely absorbed into the porous ink receiving layer so that a sufficient image density cannot be secured and multi-gradation representation becomes difficult. Thus, it is preferable that the thickness of applied ink be not less than 0.5 μm.

Figure 8:
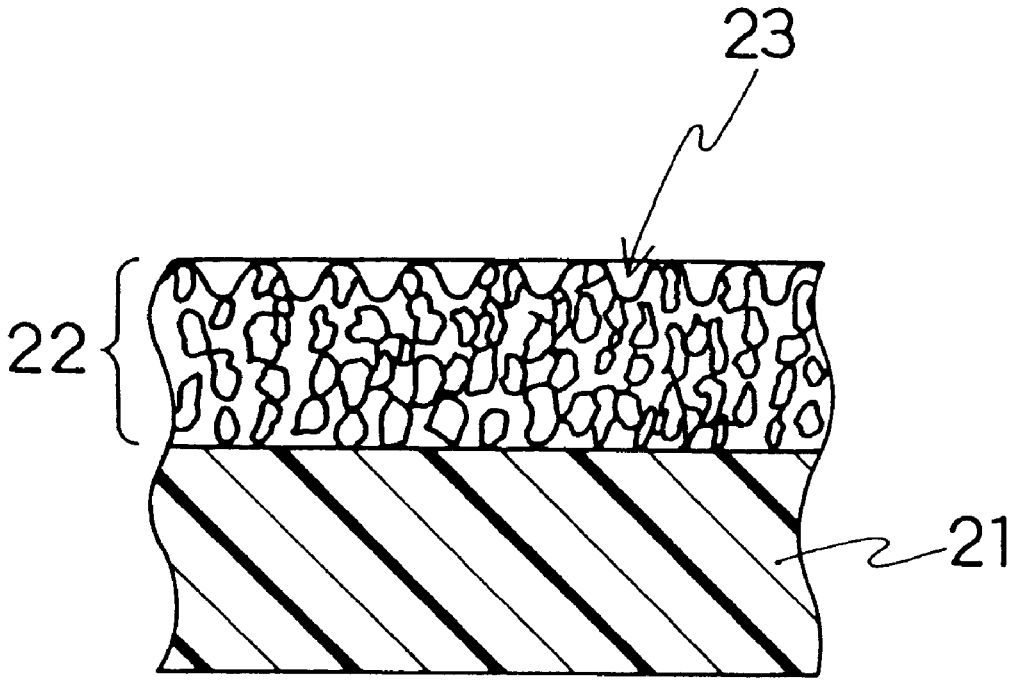
FIG. 8 is a partial sectional view showing an example of a surface porous type recording medium used in the present invention.

Next, transferring characteristics of ink have been considered when a surface porous recording medium is employed as a recording medium for forming an image. The surface porous recording medium (surface porous plastic sheet) has a structure wherein a porous ink receiving layer (porous resin layer) 22 with a thickness of, e.g., ten and several micrometers is formed on a base material 21 as shown in FIG. 8. In case of transferring thermal melting type ink onto this surface porous recording medium, it has been confirmed that ink is transferred and absorbed into pores 23 of a porous ink receiving layer to realize multi-gradation representation most favorably, provided that the surface roughness (i.e. pore diameter) of the porous ink receiving layers satisfies the following specified conditions.

Figure 9:
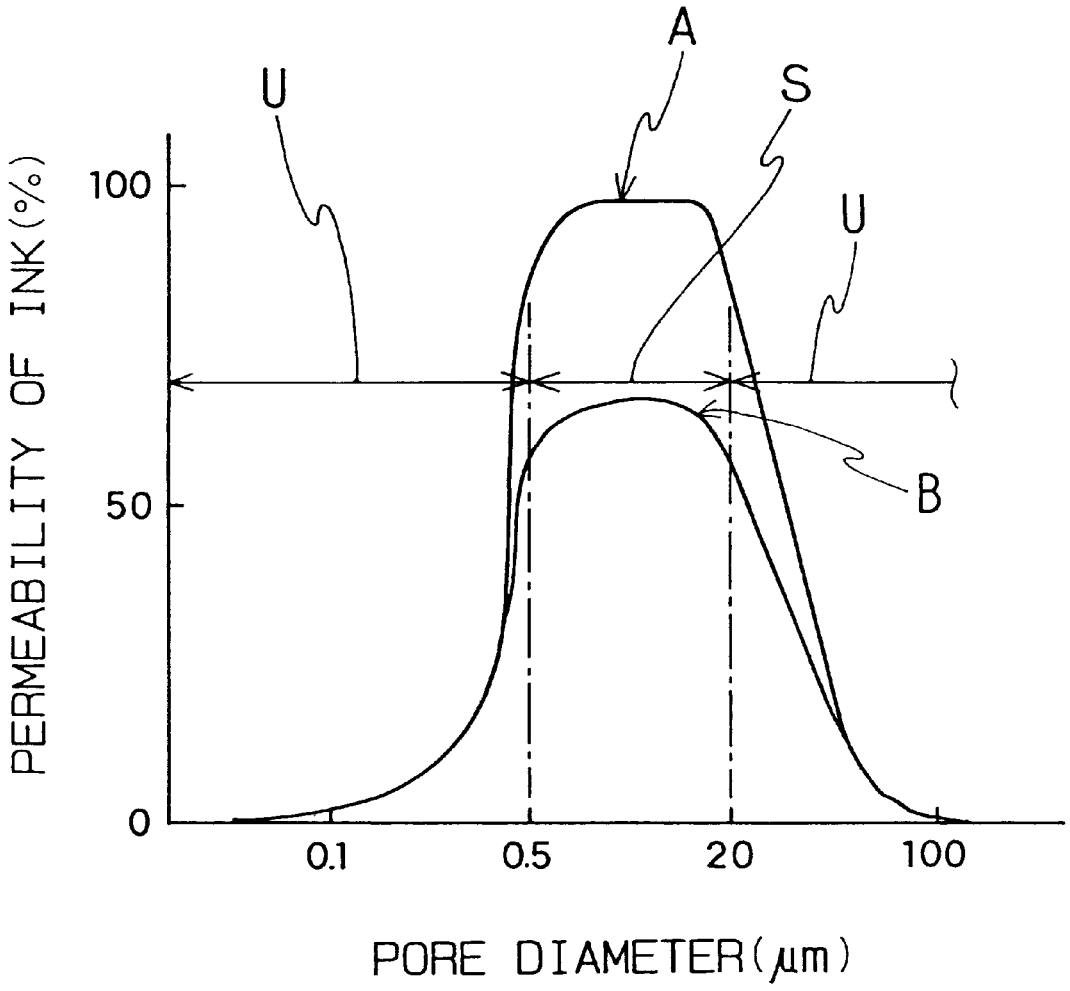
FIG. 9 is a graph showing a relationship between the pore diameter of the porous ink receiving layer of the surface porous recording medium and the permeability of ink.

FIG. 9 is a graph showing a relationship among the pore diameter of the porous ink receiving layer, the total area of aperture portions of pores, and the permeability of ink. In FIG. 9, curve A indicates a relationship between the pore diameter and the permeability of ink when the ratio of the total area of aperture portions that are occupied by all pores (hereinafter referred to as "the first total area of aperture portions") to the whole surface area of the porous ink receiving layer is 50% and the ratio of the total area of aperture portions that are occupied by pores having a pore diameter of 0.5 to 20 μm (hereinafter referred to as "the second total area of aperture portions") to the first total area of aperture portions is 70%, and curve B indicates a relationship between the pore diameter and the permeability of ink when the ratio of the first total area of aperture portions to the whole surface area of the porous ink receiving layer is 50% and the ratio of the second total area of aperture portions to the first total area of aperture portions is 60%. Here, the term "permeability of ink" indicates a ratio (%)of the amount of ink that has actually permeated into the pores to the total amount of ink that is to be transferred onto the porous ink receiving layer. In FIG. 9, region S indicates a region in which permeation of ink is stable, and region U a region in which permeation of ink is unstable. It is apparent therefrom that favorable results can be obtained when that the first total area of aperture portions of the porous ink receiving layer is in the range of 10 to 60% and the ratio of the second total area of aperture portions to the first total area of the aperture portions is 70 to 100%.

Figure 10A:
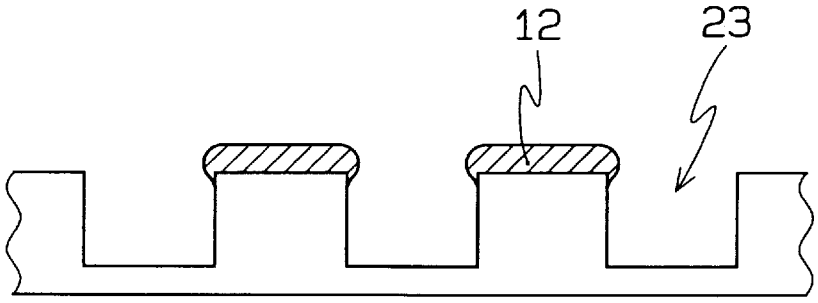
FIG. 10(A), (B) and (C) are schematic illustrations showing states where the ink is transferred onto the porous ink receiving layers with different pore diameters.
Figure 10B:
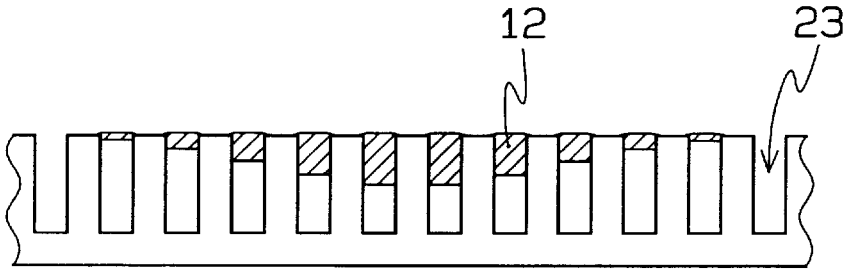
Figure 10C:
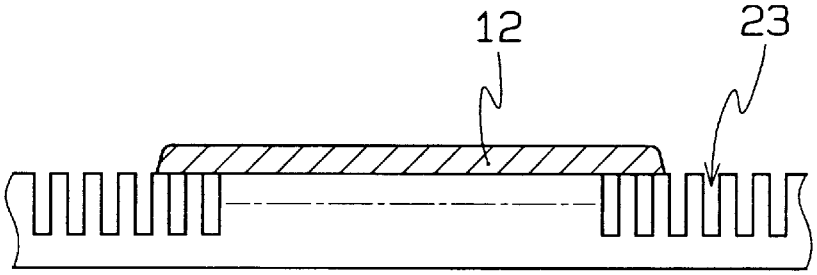

FIGS. 10(A) to (C) are schematic illustrations showing different ink transfer states where the pore diameter is larger than 20 μm, the pore diameter is 0.5 to 20 μm, and the pore diameter is smaller than 0.5 μm, respectively. When the pore diameter is larger than 20 μm, ink 12 scarcely enters the pores 23 and is transferred only onto the surface as shown in FIG. 10(A). Under such a condition, ink is transferred onto the porous ink receiving layer at a constant thickness wherein pore portions are lacking, causing unstableness in the periphery of the ink dot so that dropout portions are apt to occur in the image, and when transferring a plurality of different color inks superimposingly, transfer failure may be caused owing to influences of the thickness of ink that has been previously transferred. On the other hand, when the pore diameter is smaller than 0.5 μm, ink 12 cannot enter pores 23 as shown in FIG. 10(C) so that it is also transferred only on the surface at a constant thickness. Similarly to the above case, unstable transfer in the periphery of the ink dot and at the time of transferring plural different color inks occurs. Therefore, accurate multi-gradation recording is difficult in both of these cases in which ink of a constant thickness is transferred in an unstable state.

On the other hand, when the pore diameter is 0.5 to 20 μm, ink 12 that has been heated and melted enters pores 23 of the porous ink receiving layer as shown in FIG. 10(B). In such a case, a large amount of ink is transferred at portions corresponding to a central portion of each heating resistor unit of the thermal head which central portion is of high temperature, and only a small amount of ink is transferred at portions corresponding to peripheral portions of each heating resistor unit which are of low temperature. Thus, the amount of ink to be transferred is determined by the heating temperature, and multi-gradation recording can be performed easily. Examples of commercially available surface porous recording media are, for instance, FT-115 and FT-118 manufactured by OJI PAPER CO., LTD.

In the present invention, it has been discovered through experiments that by employing the surface porous recording medium of the above-mentioned condition and bringing ink of a donor film into close contact with the porous ink receiving layer of the recording medium, pressing the thermal head against a platen roller from the thin film side of the donor film, and controlling the area of ink melted with heating resistor units by controlling the amount of electricity to be supplied and by utilizing the above-mentioned temperature gradient of the heating resistor units, a desired amount of the ink melted can be easily and rapidly transferred from the donor film and absorbed into pores of the porous ink receiving layer depending on the amount of heat generated by the thermal head, so that multi-gradation images of high resolution and high image quality can be obtained.

When the pressing force at which the thermal head is pressed against the platen roller is small, ink cannot be sufficiently transferred and absorbed into pores of the surface porous recording medium so that the ink remains at the surface occurs sometimes. It has been discovered through experiments in the present invention that by applying a desired degree of pressure by means of a pressing means at the time of transferring ink onto the surface porous recording medium, ink can be permeated into pores of the surface porous recording medium, so that multi-gradation images of outstandingly high resolution and high quality can be obtained.

Figure 11:
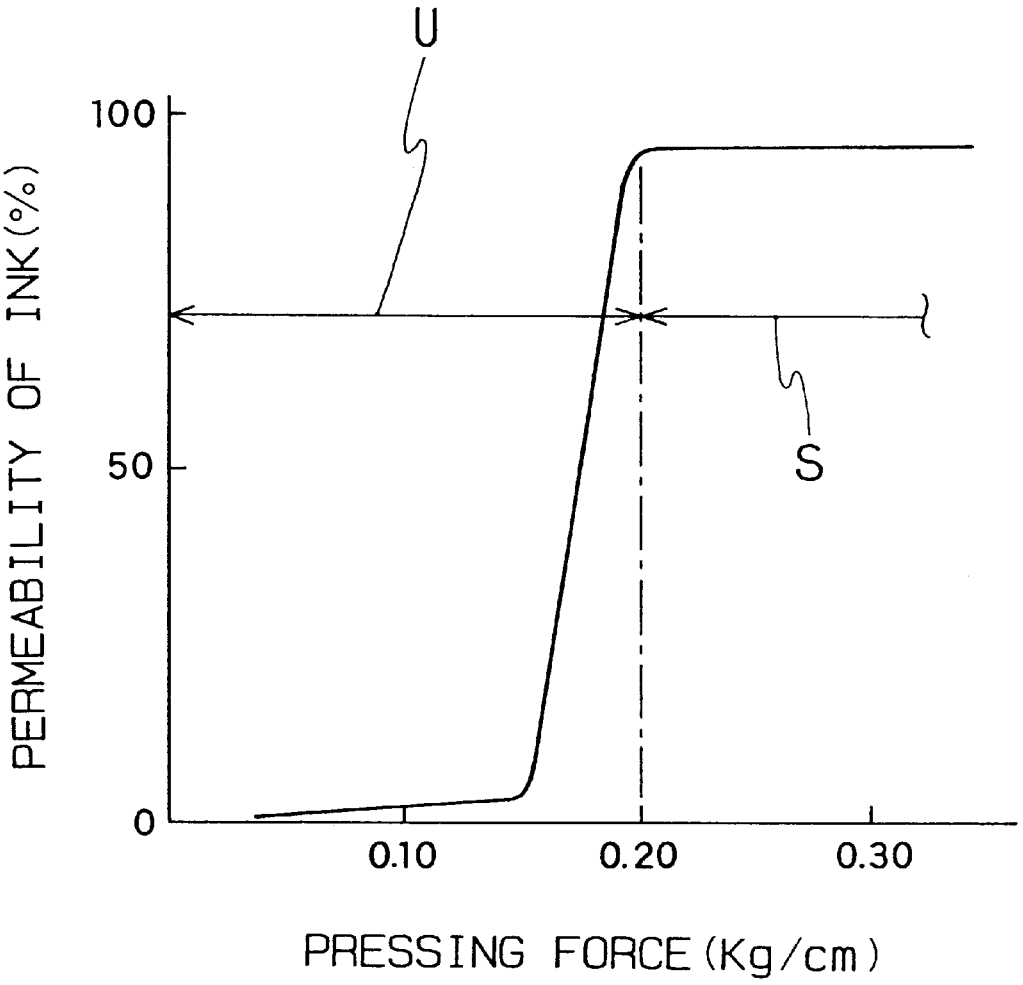
FIG. 11 is a graph showing a relationship between the pressing force of the thermal head and the permeability of ink into the porous ink receiving layer.

FIG. 11 is a graph showing a relationship between pressing force per unit printing length (kg/cm) of the pressing means and permeability (%) of ink to the surface porous recording medium. It should be noted that the results as shown herein have been obtained through experiments using a donor film composed of a thin film with a thickness of 4.5 μm and applied ink with a thickness of 2.0 μm, a surface porous recording medium with a pore diameter of 0.5 to 20 μm, and an edge type thermal head having a printing length of 260 mm (26 cm), a distance d2 between heating resistor units (distance between respective central lines of adjacent heating resistor units) of 84.5 μm (12 dots/mm), and a distance d1 between heating resistor elements (distance between respective central lines of a pair of heating resistor elements) of 30 μm. It has been confirmed through experiments that transfer of ink was unstable at a pressing force of not more than 3 kg so that ink is frequently transferred only onto the surface, ink is slightly permeated at 4 kg, and ink is surely permeated into pores at not less than 5.2 kg. Based on the fact that 5.2 kg/ 26 cm=0.20 is satisfied, it can be understood that favorable results could be obtained when the pressing force per unit length of the printing length of the thermal head is not less than 0.20 kg/cm. It should be noted that for performing transfer by applying pressure that is larger than those of the prior art, more favorable results could be obtained when using a real edge type thermal head.

On the other hand, when the pressing force became not less than 33 kg, the porous ink receiving layer of the recording medium was deformed so that marks of printing remained, and abutting stains were produced wherein thermal melting type ink was transferred onto portions which were not intended to be printed. Based on the fact that 32.5 kg/ 26 cm=1.25 is satisfied, inconveniences are caused when the pressing force per unit length of the printing length of the thermal head exceeds 1.25 kg/cm. The pressing means is required to have a certain mechanical strength to exert a pressing force of such large value, and such large pressing force is also undesirable to maximize the life of the thermal head.

In the present invention, it has further been discovered that the time required for the donor film to be exfoliated from the surface porous recording medium after the heating with the heating resistor units (hereinafter referred to as "exfoliation time") affects the quality of images, and it has been confirmed that it is desirable to make the time required for the exfoliation short. Ink that has been heated and melted with heating resistor units is absorbed into pores of the surface porous recording medium to form an image, but there also exist portions wherein the melted ink remains on the surface without being absorbed at portions of the image where the optical density is high. When a long time elapses until exfoliation of the donor film from the surface porous recording medium is accomplished, the ink existing on the surface that is still in a molten state is cooled and at that time combined to the ink already absorbed into pores so that a phenomenon occurs wherein the ink on the surface is finally transferred onto an image formed in pore portions when the donor film is exfoliated from the surface porous recording medium. Consequently, the ink is excessively transferred onto an image in pore portions so that portions of high optical density may be formed. This is apt to occur at end portions of images. While such a phenomenon may be eliminated by slightly adjusting an angle for exfoliation or tension of the ink ribbon, this will result in a complicated structure of the printer and thus makes the printer expensive.

Figure 12:
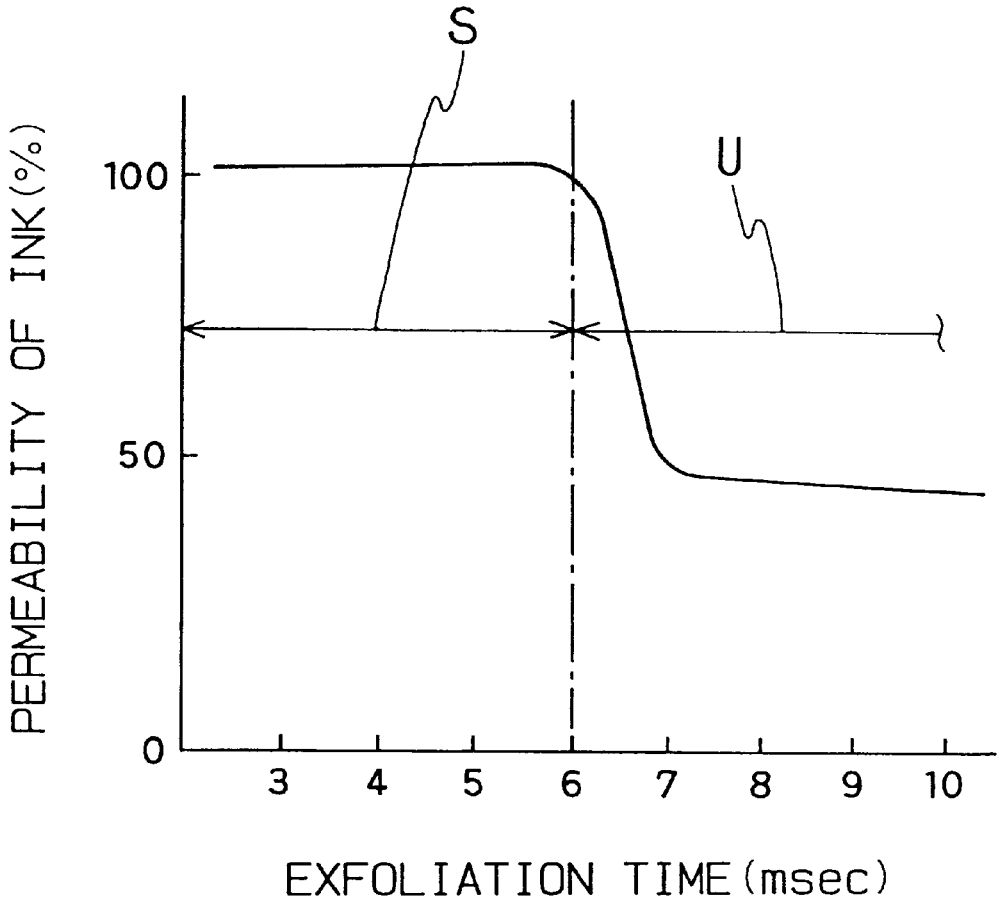
FIG. 12 is a graph showing a relationship between the time required for the donor film to be exfoliated from the surface porous recording medium after heating with the thermal head, and the permeability of ink.

FIG. 12 is a graph showing a relationship between exfoliation time and ink permeability when the exfoliation angle or tension of the printer is not slightly adjusted. In the present invention, it has been confirmed through experiments that with an exfoliation time exceeding 6 msec, permeation of ink into pores becomes unstable and high optical density portions are produced owing to the ink excessively transferred onto the image in pore portions, while with an exfoliation time of not more than 6 msec, the permeation of ink into pores becomes stable.

With respect to the relationship between printing speed and edge distance D (distance between the end of a heating resistor element and the edge 5 of a thermal head as shown in FIG. 1(B)) when the exfoliation is performed with an exfoliation time being not more than 6 msec the edge distance D will be 152.4 μm when the printing speed is 25.4 mm/sec (1 inch/sec). Since the printing speed of generally used color printers is not less than 25.4 mm/sec (1 inch/sec), it is preferable that the edge distance D be not more than 150 μm.

While a typically used thermal head is a flat head, its edge distance D is as small as in the range of 3 to 10 mm, and for achieving an exfoliation time of 6 msec, its printing time needs to be 500 mm/sec which is not appropriate for practical use. In order to achieve an exfoliation time of not more than 6 msec, it goes without saying that an edge head in which heating resistor elements are arranged in close proximity to the edge, and especially a real edge type head, is favorably used.

Figure 13:
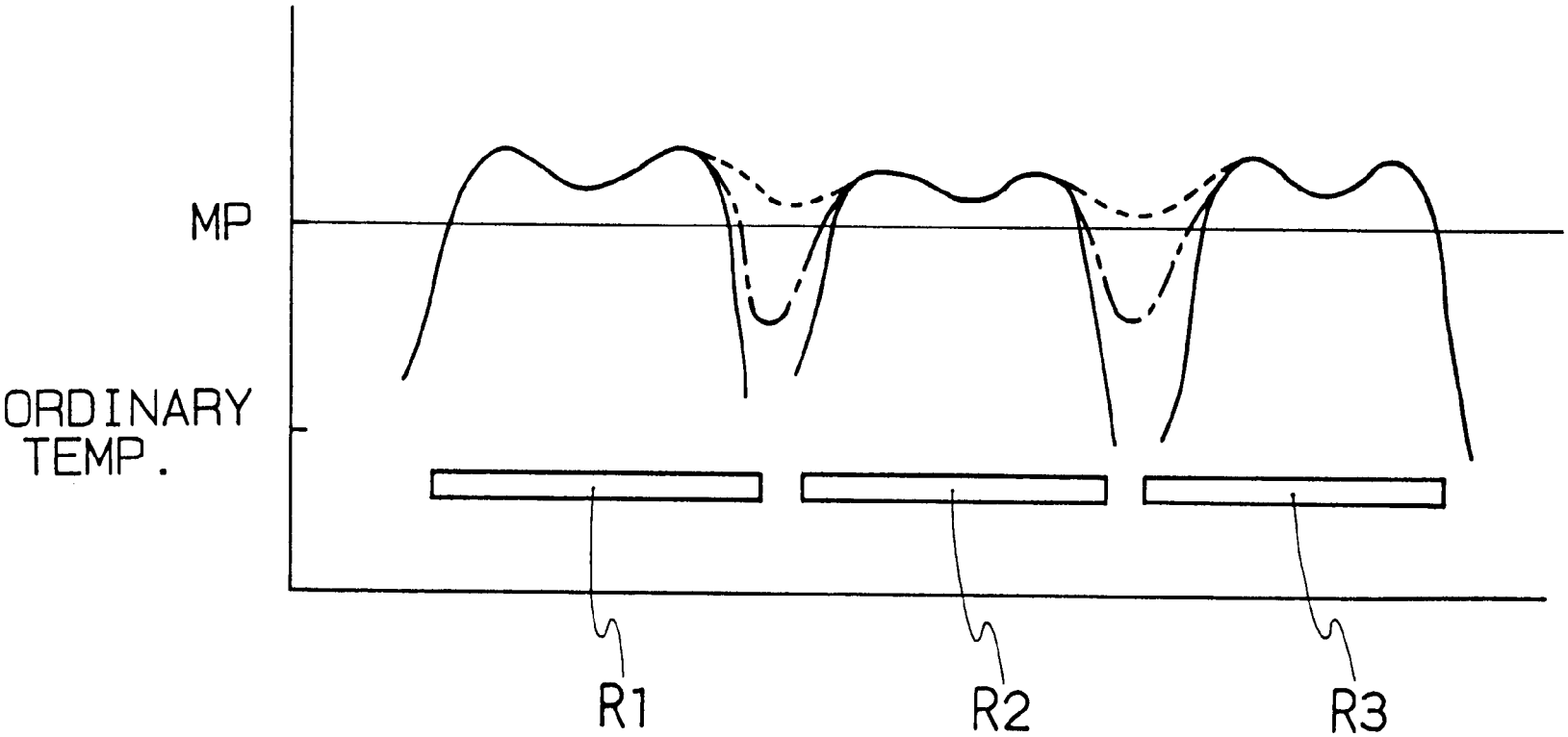
FIG. 13 is a graph showing a temperature distribution of a thermal head used in the present invention.

FIG. 13 is a graph showing a temperature distribution on the surface of the thermal head used in the present invention. As already described, respective heating resistor units R1, R2 and R3 of the thermal head have a temperature gradient as shown by solid lines in which the temperature is high around each of heating resistor elements paired and decreases toward the peripheral portions thereof. When all of the heating resistor units R1, R2 and R3 are activated with the distance d1 between the heating resistor elements paired and the distance d2 between the heating resistor units satisfying: d1=0.5d2, the temperature distribution at boundary portions between two heating resistor units will substantially correspond to a sum of the respective temperature distributions of the two heating resistor units as shown by the broken lines so that the boundary becomes ambiguous. On the other hand, when the heating resistor units are activated with the distance d1 between the paired heating resistor elements of identical shape and the distance d2 between the heating resistor units in the thermal head satisfying: $0.25 \times d2 < d1 \leqq 0.4 \times d2$, the temperature distribution will be one as shown by the one dot chain lines and favorable gradation characteristics can be obtained. Further, when the distance d1 between the paired heating resistor elements of identical shape and the distance d2 between the heating resistor units in the thermal head have a relation: $d1 \leqq 0.25 \times d2$, the distance between the heating resistor elements are too remote as compared to the distance d2 between adjacent heating resistor units, and excessive printing energy is required for performing solid printing as compared to that required for normal printing, which leads to unfavorable results. Due to these facts, it is desirable that the relationship between the distance d1 between the paired heating resistor elements of identical shape and the distance d2 between the heating resistor units in the thermal head satisfy: $0.25 \times d2 < d1 \leqq 0.4 \times d2$ .

Figure 14:
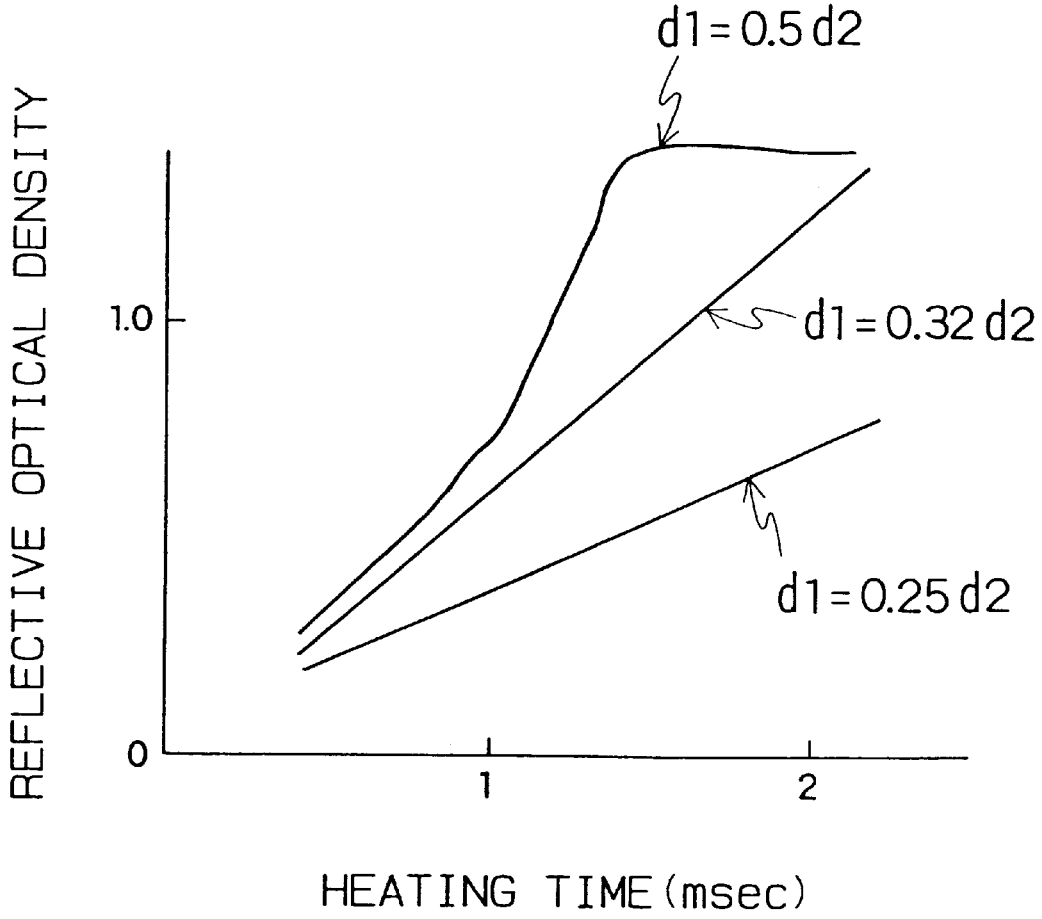
FIG. 14 is a graph showing a relationship between the heating time and the reflective optical density of the ink transferred when the relationship of the distance d1 between a pair of the heating resistor elements with the distance d2 between the heating resistor units is changed.

FIG. 14 is a graph showing a relationship between heating time and reflective optical density (OD) of ink transferred onto a recording medium in case the relationship between the distance d1 between the paired heating resistor elements of identical shape and the distance d2 between the heating resistor units in the thermal head is varied. Experiments were performed wherein a thermal head of 8 dots/mm is used, the maximum number of gradations was 255, the heating time was 3.2 msec when the number of gradations was maximum, and a donor film in which ink was applied in a thickness of 2 $\mu$m onto a thin film having a thickness of 4.5 $\mu$m was used. As shown in FIG. 14, in case of $d1=0.5d2$, the temperature became unstable owing to mutual heat interference of adjacent heating resistor elements so that unstable regions where the optical density was unstable resulted, while when $0.25 \times d2 < d1 \leqq 0.4 \times d2$ was satisfied, a multi-gradation image of high image quality which was stable over the entire region from low optical density region to high optical density region could be obtained. On the other hand, when of $d1=0.25d2$, no sufficient optical density could be obtained at solid-printed regions so that no satisfactory results could be obtained.

Considering the distance between heating resistor units of the thermal head, the distance between heating resistor units of the thermal head as used, for instance, in a facsimile is about 8 dot/mm, and for obtaining a multi-gradation image of high resolution and high image quality which are of visually sufficient level, the distance between the heating resistor units is required to be not more than 8 dot/mm.

Figure 15:
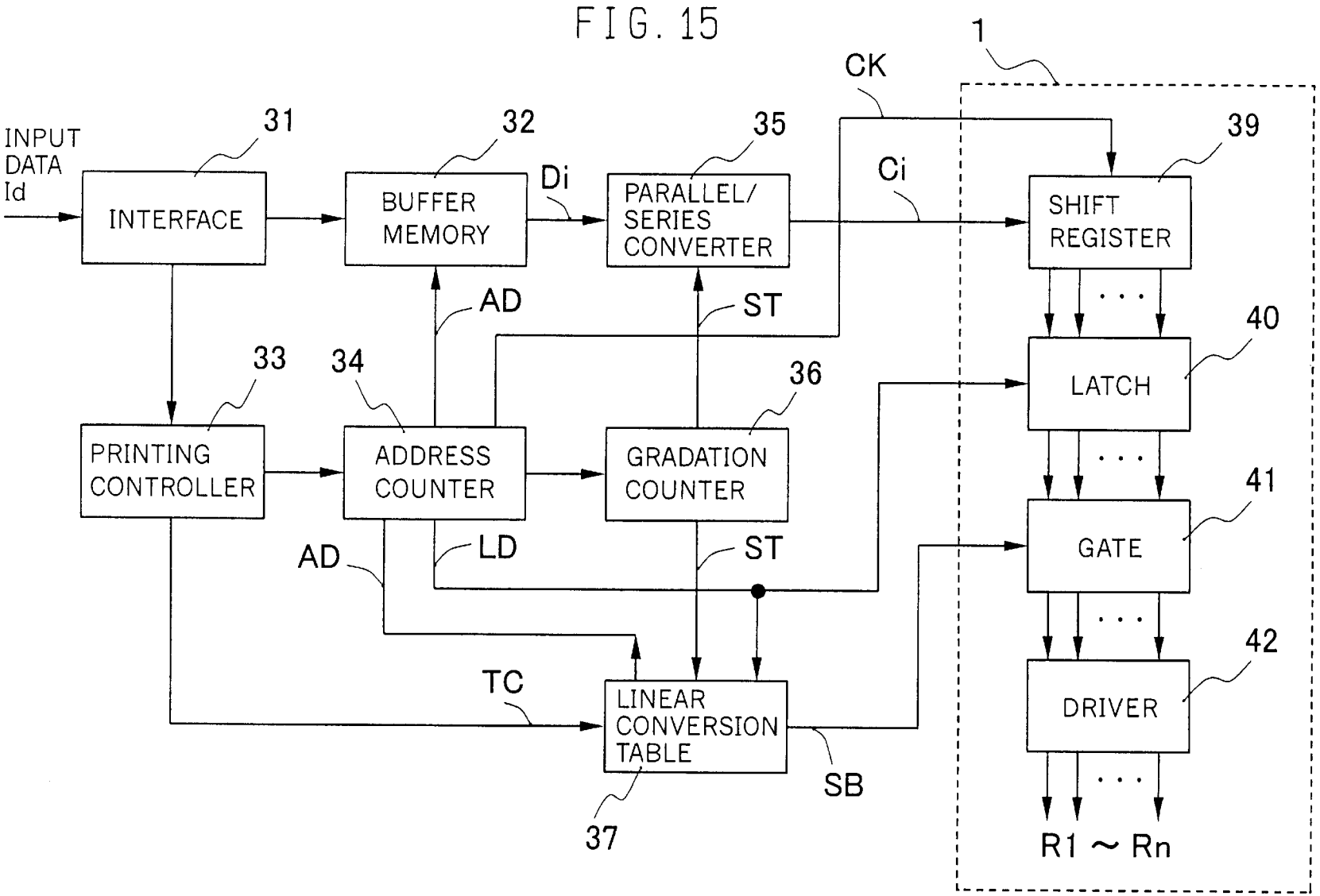
FIG. 15 is a block diagram showing an example of a gradation control circuit used in the present invention.

As the gradation control means for controlling the amount of melted ink of the ink layer with heating resistor units by controlling the amount of electricity supplied to the thermal head which is used in the present invention, for instance, the gradation control circuit as disclosed in the above JP, A, 6-286181 can be favorably used. FIG. 15 is a block diagram showing an example of the gradation control circuit used in the present invention, and FIG. 16 a block diagram showing detailed arrangements of the linear conversion table of FIG. 15.

In FIG. 15, input data Id, which include image data obtained by an image input device such as TV camera and processed by a personal computer or the like, are input to an interface circuit 31. These input data Id include, in addition to the image data, control data required for a thermal transfer recording device, and represent gradation number corresponding to an image to be recorded. From the input data Id that are input to the interface circuit 31, the image data are input to a buffer memory 32 and the control data to a printing control circuit 33. The printing control circuit 33 generates various control signals in compliance with operations of the thermal transfer recording device. Here, the thermal transfer recording device includes the thermal head 1 and donor film 10, etc.

The printing control circuit 33 supplies a starting signal to an address counter 34 in compliance with operations of the thermal transfer recording device, and a selective signal TC to a linear conversion table 37 corresponding to operating conditions of the thermal transfer recording device, that is, the color of ink of the donor film or heating pattern for printing and so on. The address counter 34 generates an address AD in response to the starting signal and supplies it to the buffer memory 32. In compliance with this address AD, the buffer memory 32 sequentially outputs one-line data Di (D1 to Dn) for the thermal head 1 out of the input image data to a parallel/series conversion circuit 35.

The one-line data Di for the thermal head 1 that is output from the buffer memory 32 will be explained in detail. Here, for instance, a case in which a gradation image whose gradation number is m is represented by using the thermal head 1 having heating resistor units arranged in a line as mentioned above is taken. For representing a gradation image with a gradation number of m, m stages of current (heating pulse) is applied to respective heating resistor units R1 to Rn. Thus, with respect to the one-line data Di that are output from the buffer memory 32, data D1 to Dn which correspond to respective heating resistor units R1 to Rn and each of which corresponds to one of from the first gradation to m-th gradation are applied to respective heating resistor units R1 to Rn. These data Di will be sequentially output for each line (L1, L2, . . . ).

The address counter 34, in turn, outputs a pulse to a gradation counter 36 each time when one-line data Di for the thermal head 1 are read out from the buffer memory 32. The gradation counter 36 generates a gradation signal ST on the basis of the input pulse, and supplies the signal to the parallel/series conversion circuit 35 and the linear conversion table 37. The gradation signal St is such a signal that it represents 1 when the data Di is for the first gradation, 2 when the data Di is for the second gradation, and m when the data Di is for the m-th gradation.

The parallel/series conversion circuit 35 then performs comparison between respective data Di (D1 to Dn) and the gradation signal ST, and when data Di is larger than or equal to the gradation signal ST ($Di \geqq ST$), a comparison signal Ci of 1 is generated, and when data Di is smaller than the gradation signal ST ($Di < ST$), a comparison signal Ci of 0 is generated. The comparison signal Ci is input to a shift register 39 within the thermal head 1. The shift register 39 is input with clock CK from the address counter 34, and the comparison signal Ci that is input in the shift register 39 is shifted by the clock CK so that comparison signals Ci for one line are arranged in the shift register 39.

Each time when one-line data Di for the thermal head 1 are read out from the buffer memory 32, the address counter 34 outputs a load pulse LD to a latch circuit 40 and the linear conversion table 37. The comparison signals Ci for one line that are arranged in the shift register 39 are stored in the latch circuit 40 in response to this load pulse LD. The comparison signals Ci that are output from the latch circuit 40 are input to a gate circuit 41.

The gate circuit 41 generates a signal representing whether the heating resistor units R1 to Rn are to be heated (ON) or not (OFF) upon receipt of the comparison signal Ci. That is, when the comparison signal Ci is 1, ON is selected and when the comparison signal Ci is 0, OFF is selected. Depending on comparison signals Ci respectively corresponding to the heating resistor units R1 to Rn from the first to m-th gradation, heating conditions for each of the heating resistor units R1 to Rn are determined.

Figure 16:
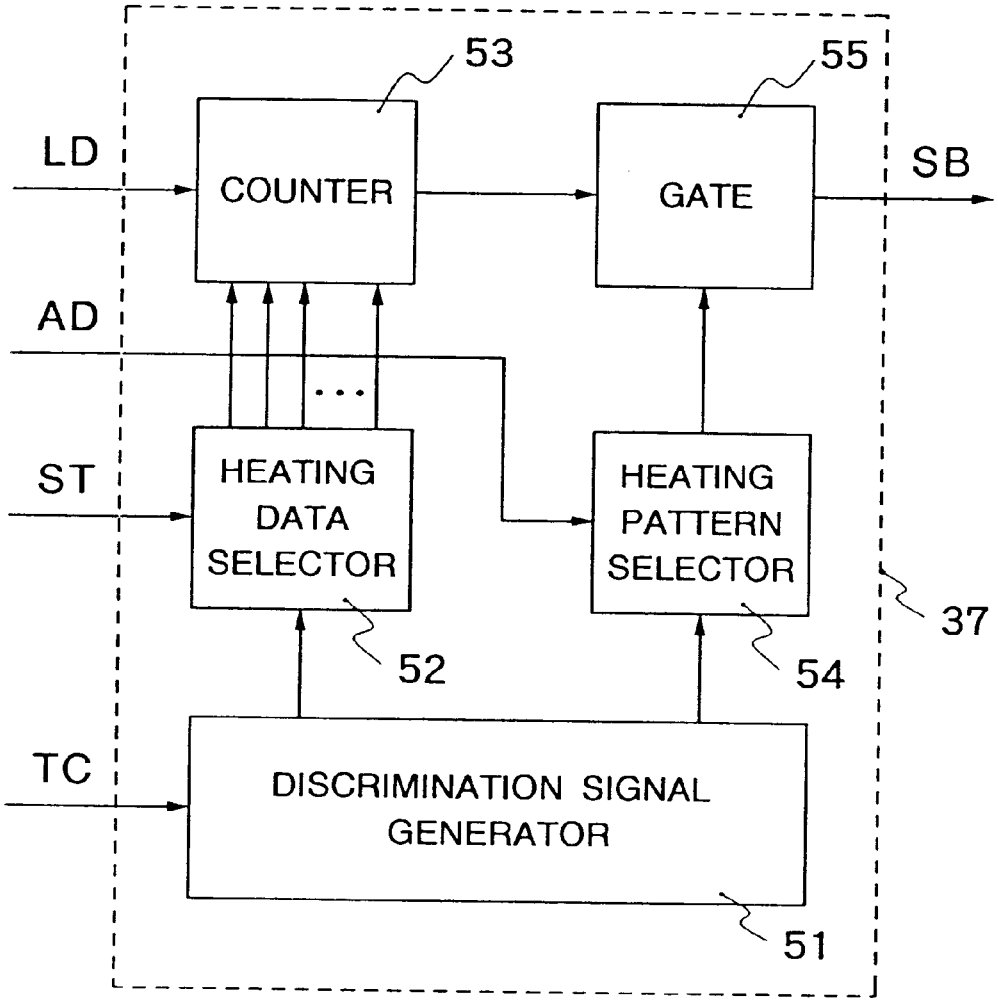
FIG. 16 is a block diagram showing a concrete configuration of the linear conversion table in FIG. 15.

On the other hand, the selective signal TC, address AD, gradation signal ST and load pulse LD are input to the linear conversion table 37 which outputs a heating time setting signal SB. An example of a concrete arrangement for the linear conversion table 37 is shown in FIG. 16. The selective signal TC is input to a discrimination signal generating circuit 51, and the discrimination signal generating circuit 51 outputs a discrimination signal corresponding to Y ink, M ink, C ink or K ink to a heating data selecting circuit 52 and heating pattern selecting circuit 54. Into the heating data selecting circuit 52, the gradation signal ST is input, and the heating data selecting circuit 52 inputs a count number that is set for each respective gradation signal ST to a counter 53. The counter 53 starts counting upon input of load pulse LD, and performs counting for a count number as set by the heating data selecting circuit 52. The address AD is input to the heating pattern selecting circuit 54, and the heating pattern selecting circuit 54 outputs a heating pattern signal corresponding to each heating pattern as shown in FIG. 2 to a gate circuit 55. The gate circuit 55 performs gating of the signals output from the counter 53 depending on the respective heating patterns and outputs a heating time setting signal SB.

The heating time for the first to m-th gradation is set so as to provide a density characteristics that is as linear as possible by measuring the optical density for each gradation. The count numbers that are set in the heating data selecting circuit 52 are set on the basis of the heating time for each gradation. Thus, the ON period for the heating time setting signal SB that is output from the gate circuit 55 is set to a period corresponding to each gradation.

Therefore, the respective heating times tR1 to tRn for the heating resistor units R1 to Rn are gated by turning the heating time setting signal SB ON/OFF in respective gradations. Actually, the heating resistor units R1 to Rn are heated when the heating time setting signal SB within the heating time as set by the comparison signal Ci is in an ON period. In this manner, the heating time for each of the heating resistor units R1 to Rn is finely set on the basis of heating time setting signals SB respectively from the first to m-th gradation.

As described above,the gate circuit 41 generates an ON pulse at heating period for each heating resistor unit that is determined by the comparison signal Ci input from the latch circuit 40 and the heating signal setting signal SB input from the linear conversion table 37, and this pulse is supplied to the driver circuit 42. Thus, the shift register 39, the latch circuit 40 and the gate circuit 42 function as a pulse outputting means for outputting pulse for heating the heating resistor units of the thermal head 1. The driver circuit 42 passes currents through the heating resistor units R1 to Rn on the basis of this pulse so that the donor film is heated to transfer the applied ink onto a recording medium, thereby recording a multi-gradation image. With this arrangement, the amount of heat applied to the donor film may be finely set so that multi-gradation representation can be realized using thermal melting type ink.

As the ink used in the donor film, thermal melting type inks each containing usual coloring agent and a vehicle comprising a wax as a main ingredient and optionally a thermoplastic resin can be employed. The compositions of inks as employed in each of the above experiments are shown in Table 1. When the ink layer is thin, it will be required to increase the amount of coloring agent.

TABLE 1

| Ink composition (parts by weight) | Yellow | Magenta | Cyan |
|---|---|---|---|
| Benzidine Yellow | 20 | | |
| Brilliant Carmine 6B | | 20 | |
| Phthalocyanine Blue | | | 20 |
| α-Olefin/maleic anhydride copolymer wax (melting point 72° C.) | 25 | 25 | 25 |
| Paraffin wax (melting point 70° C.) | 50 | 50 | 50 |
| Ethylene/vinyl acetate copolymer (softening point 78° C., melt index 2500) | 5 | 5 | 5 |

As described above, the melting type thermal transfer recording device or recording method of the present invention is characterized in that it comprises: a donor film comprising a thin film and a thermal melting type ink layer provided on the thin film, the thermal melting type ink layer having a thickness in a range of 0.5 to 2.5 μm, a surface porous type recording medium comprising a base material and a porous ink receiving layer having numerous minute pores provided on the base material, the ratio of the first total area of aperture portions that are occupied by all the pores to the whole surface area of the porous ink receiving layer being in a range of 10 to 60%, and the ratio of the second total area of aperture portions that are occupied by pores having a pore diameter of 0.5 to 20 μm to the first total area of the aperture portions being 70 to 100%, a thermal head comprising a plurality of heating resistor units arranged in a line at intervals of 8 dots/mm or less, each of the heating resistor units comprising a pair of heating resistor elements of identical shape, a gradation control means for controlling an amount of an ink of the ink layer melted with the heating resistor units by controlling an amount of electricity supplied to the thermal head, and in that the device or method is arranged such that while the ink layer of the donor film is brought into close contact with the porous ink receiving layer of the surface porous recording medium whereupon the thermal head is pressed from the thin film side of the donor film, the amount of melted ink of the ink layer is controlled by the gradation control means to form a multi-gradation image on the surface porous recording medium. With this feature, it has been enabled to obtain multi-gradation images of extremely high resolution and high image quality.

What is claimed is:

1. A melting type thermal transfer recording device comprising:

a donor film comprising a thin film and a thermal melting type ink layer provided on the thin film, the thermal melting type ink layer having a thickness in a range of 0.5 to 2.5 μm, a surface porous type recording medium comprising a base material and a porous ink receiving layer having numerous minute pores provided on the base material, the ratio of the first total area of aperture portions that are occupied by all the pores to the whole surface area of the porous ink receiving layer being in a range of 10 to 60%, and the ratio of the second total area of aperture portions that are occupied by pores having a pore diameter of 0.5 to 20 μm to the first total area of the aperture portions being 70 to 100%, a thermal head comprising a plurality of heating resistor units arranged in a line at intervals of 8 dot/mm or less, each of the heating resistor units comprising a pair of heating resistor elements of identical shape, a gradation control means for controlling an amount of an ink of the ink layer melted with the heating resistor units by controlling an amount of electricity supplied to the thermal head, wherein the device is arranged such that while the ink layer of the donor film is brought into close contact with the porous ink receiving layer of the surface porous recording medium whereupon the thermal head is pressed from the thin film side of the donor film, the amount of melted ink of the ink layer is controlled by the gradation control means to form a multi-gradation image on the surface porous recording medium.

2. A melting type thermal transfer recording device according to claim 1, wherein the thermal head is a real edge type thermal head with an edge distance of not more than 150 μm, and the pressing force of the thermal head is in a range of 0.20 to 1.25 kg/cm, and wherein there is provided a mechanism for exfoliating the donor film from the surface porous recording medium within 6 msec after the heating with the heating resistor units.

3. The melting type thermal transfer recording device according to claim 1, wherein a distance d1 between a pair of heating resistor elements of identical shape and a distance d2 between the heating resistor units in the thermal head are related to each other in that they satisfy: $0.25 \times d2 < d1 \leqq 0.4 \times d2$.

4. A melting type thermal transfer recording method comprising: using a donor film comprising a thin film and a thermal melting type ink layer provided on the thin film, the thermal melting type ink layer having a thickness in a range of 0.5 to 2.5 μm, a surface porous type recording medium comprising a base material and a porous ink receiving layer having numerous minute pores provided on the base material, the ratio of the first total area of aperture portions that are occupied by all the pores to the whole surface area of the porous ink receiving layer being in a range of 10 to 60%, and the ratio of the second total area of aperture portions that are occupied by pores having a pore diameter of 0.5 to 20 μm to the first total area of the aperture portions being 70 to 100%, and a thermal head comprising a plurality of heating resistor units arranged in a line at intervals of 8 dot/mm or less, each of the heating resistor units comprising a pair of heating resistor elements of identical shape; and while bringing the ink layer of the donor film into close contact with the porous ink receiving layer of the surface porous recording medium and pressing the thermal head thereupon from the thin film side of the donor film, controlling an amount of an ink of the ink layer melted with the heating resistor units by controlling an amount of electricity supplied to the thermal head to form a multi-gradation image on the surface porous recording medium.

5. The melting type thermal transfer recording method according to claim 4, wherein the thermal head is a near edge type thermal head with an edge distance of not more than 150 μm, and the pressing force of the thermal head is in a range of 0.20 to 1.25 kg/cm, and wherein the donor film is exfoliated from the surface porous recording medium within 6 msec after the heating with the heating resistor units.

6. The melting type thermal transfer recording method according to claim 4, wherein a distance d1 between a pair of heating resistor elements of identical shape and a distance d2 between the heating resistor units in the thermal head are related to each other in that they satisfy: $0.25 \times d2 < d1 \leqq 0.4 \times d2$.

* * * * *